United States Patent [19]

Carluccio

[11] Patent Number: 4,545,696

[45] Date of Patent: Oct. 8, 1985

[54] COSMETIC CONTAINER

[76] Inventor: John F. Carluccio, 836 High Mountain Rd., Franklin Lakes, N.J. 07417

[21] Appl. No.: 518,218

[22] Filed: Jul. 28, 1983

[51] Int. Cl.[4] ..... B43K 5/06

[52] U.S. Cl. ..... 401/175; 401/75

[58] Field of Search ..... 401/49, 88, 89, 90, 401/75, 172, 173, 175, 55, 243, 246

[56] References Cited

U.S. PATENT DOCUMENTS

| | | | |
|---|---|---|---|
| 1,194,545 | 8/1916 | Remington | 401/75 |
| 1,322,729 | 11/1919 | Remington | 401/75 |
| 2,098,170 | 11/1937 | Teas | 401/246 |
| 2,816,309 | 12/1957 | Worth et al. | 401/175 |
| 2,816,654 | 12/1957 | Fuller et al. | 401/75 |
| 2,818,167 | 12/1957 | McKinley | 401/75 |
| 2,827,164 | 3/1958 | Anderson | 401/75 |
| 2,840,231 | 6/1958 | Reichenbach | 401/75 |
| 2,876,161 | 3/1959 | Gieschi | 401/68 |
| 2,917,765 | 12/1959 | Jakubowski | 401/175 |
| 2,935,191 | 5/1960 | Leshin | 401/75 |
| 3,212,120 | 10/1965 | Gentile | 401/175 |
| 4,298,036 | 11/1981 | Horvath | 401/55 |
| 4,363,560 | 12/1982 | Gentile | 401/175 |
| 4,369,158 | 12/1983 | Woodruff et al. | 401/175 |

*Primary Examiner*—Hugh R. Chamblee
*Assistant Examiner*—Carolyn A. Harrison
*Attorney, Agent, or Firm*—Brumbaugh, Graves, Donohue & Raymond

[57] ABSTRACT

A deodorant case of the propel-repel type has a propel-repel assembly, which is received in one end of the casing body. The assembly includes a carrier, a base, and a threaded rod assembly which may be pre-assembled as a unit and inserted in the casing prior to filling. The casing is filled from the bottom through aligned openings in the base and carrier, and through an opening in a knurled disc of the threaded rod assembly which may be aligned for filling. After filling, a plug is snapped on over the opening in the knurled disc. In an alternative embodiment, the propel-repel assembly has no filling holes, but is pre-assembled as a unit and snapped into the casing after filling. In both embodiments, vent holes may be formed in the carrier, base, and disc. The invention may also be applied to containers which have manually propelled carriers.

8 Claims, 9 Drawing Figures

COSMETIC CONTAINER

BACKGROUND OF THE INVENTION

This invention relates to deodorant cases, and, more particularly, to deodorant cases of the propel-repel type.

There exist on the market deodorant cases of great variety. One of the most popular is the type known as the propel-repel type. This means that the carrier is seated on a threaded rod, the turning of which will raise the carrier or lower it, depending upon the direction of rotation of the knob.

It is known and generally desirable to back fill cosmetic containers, that is, to fill the container from its bottom. Prior to attaching the cap, the upper, open end of the container is placed in a jig or a puck which has the configuration of the finished product, and the container is filled with the carrier in place. Thereafter, the product solidifies and the remainder of parts of the container are assembled. A drawback of this type of filling technique is that excessive labor is required to assemble the package.

SUMMARY OF THE INVENTION

This invention is an improved construction of a deodorant container, preferably of the propel-repel type, which simplifies the filling and finished packaging of the container.

DETAILED DESCRIPTION OF PREFERRED EMBODIMENTS

Figure 1:
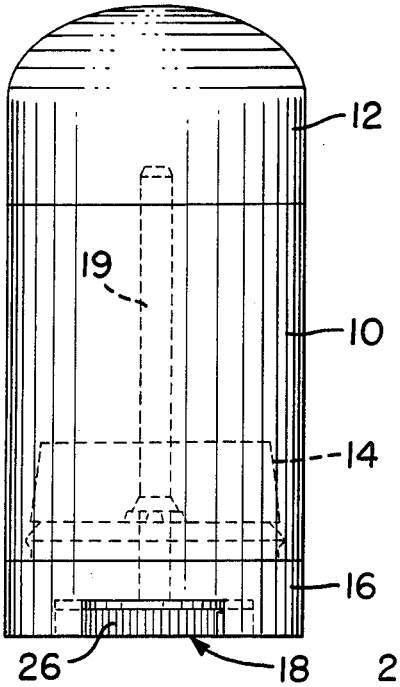
FIG. 1 is a front view of a container in accordance with the invention.
Figure 2:
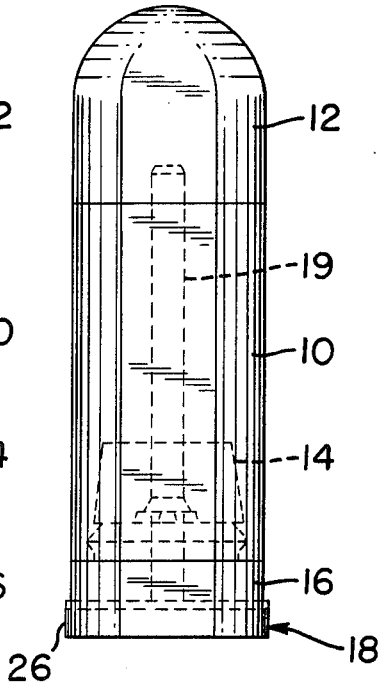
FIGS. 2 and 3 are side and bottom views, respectively, of the container shown in FIG. 1.
Figure 3:
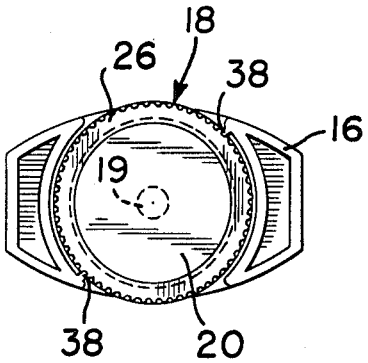
Figure 7:
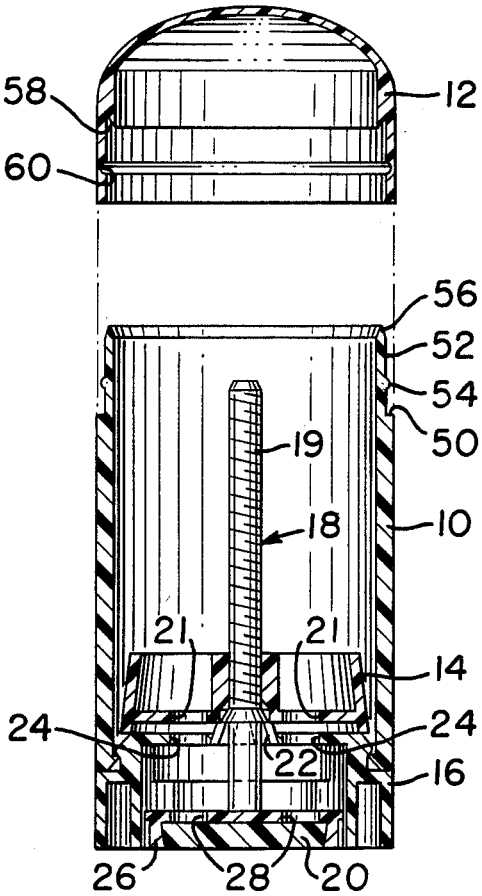
FIG. 7 is a front sectional view of the container shown in FIG. 1.

In accordance with a preferred embodiment of the invention, as shown in FIGS. 1–7, a deodorant case of the propel-repel type is provided which includes a casing or body 10. As shown in FIGS. 1, 2 and 7, a cap 12 is adapted to fit over the shoulder of the body 10 and frictionally engage the top of the body.

As described in my copending U.S. application Ser. No. 481,720, filed Apr. 4, 1983, which is incorporated herein by reference, certain ingredients in deodorants and antiperspirants, e.g. alcohol, tend to evaporate. As a result, most deodorant containers employ a screw cap to minimize air infiltration. While such a cap may be employed in this invention, preferably a sealing cap and body arrangement of the type shown and described in U.S. application Ser. No. 481,720 is employed.

As shown in the drawings, the body 10 is formed with a stepped edge 50 which extends into the neck 52 of the container's body. The wall of the neck 52 is formed with a bead 54 at a point somewhat below the midpoint of the neck. It also has an inverted v-shape at its open end 56.

The cap 12 fits over the neck 52. The cap interior is formed with a circular v-shaped indentation 58 that is aligned with and adapted to receive the v-shaped end wall 56 of the neck 52. The cap interior is also formed with an indentation 60 which is adapted to receive the bead 54 in the wall of the neck 52 and hold the cap 20 in place on the neck.

Preferably, the inside diameter of the cap is slightly smaller than the outside diameter of the protrusion 54 in the neck 52. Slippage by the cap 12 on the neck 52 is thereby prevented. It will also be observed that the male-female mating relationship between the end wall of the neck and the groove 58 of the cap creates a tortuous flow path for air that might otherwise reach and cause the evaporation of the deodorant or antiperspirant, as the case might be, held in place in the body of the container. The life of any deodorant or antiperspirant is therefore improved by the sealing arrangement of this invention.

Adapted to snap into the body 10 is a propel-repel assembly which includes a carrier 14, a base 16, a threaded rod assembly 18 and a plug 20. The carrier 14 has a frusto-conical shape with a threaded bore 15 adapted to receive the threaded rod 19 forming a part of the threaded rod assembly 18. The carrier 14 also includes two holes 21 formed through the carrier support surface. The carrier is tapered so as to be freely moveable in an upward and downward direction, the only limitation on such movement being an engagement between the base of the carrier and the wall of the casing 10.

Figure 5:
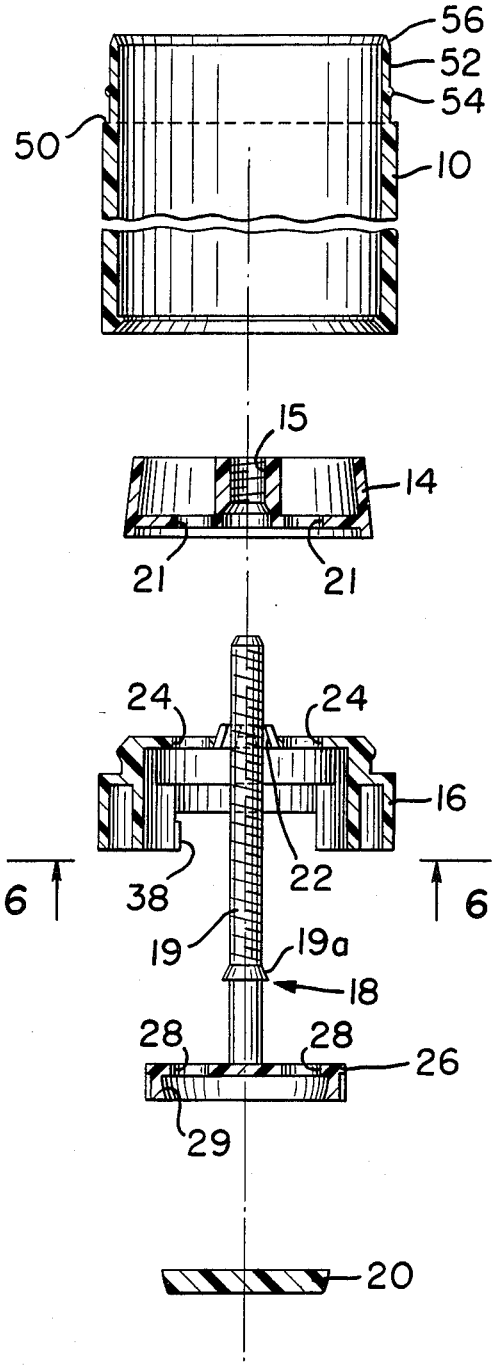
FIG. 5 is an exploded front, sectional view of the parts of the container shown in FIG. 4, taken through lines 5—5.
Figure 6:
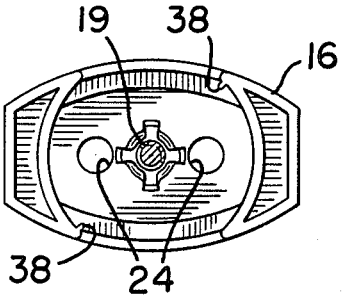
FIG. 6 is a bottom, sectional view taken through lines 6—6 of FIG. 5.

The base 16 includes a tapered hole 22 through which the threaded rod 19 of the assembly 18 passes. It will be observed that the rod includes an enlarged chamfer **19*a* which is able to pass through the tapered opening 22 formed in the base upon insertion. But, because of the taper in the opening of the base and its configuration, the tapered rod is prevented from being pulled back from the base. The base further includes axial openings 24 that are aligned with the openings 21 formed in the carrier. The knurled knob 26 of the threaded rod further includes axial holes 28 that are aligned, during assembly and filling, with the holes 21, 24 formed in the base and the carrier. It is through the openings that the casing is filled with a product. As shown in FIG. 5, vent holes 30, 32, 34 may be provided in the carrier, base, and knob to relieve pressure during filling. The plug 20 fits into a recess 29** in the base of the knurled knob and covers the axial openings and vent holes after filling to seal the bottom of the container.

Finally, it will be observed that the base 16 includes tabs 38 (FIGS. 3, 5) which extend into the body and lock the threaded rod assembly 18 in place during the filling process. The first turning of the knurled disc 26 will cause the tabs to break away from the base so as to permit a freedom of movement by the propel-repel assembly.

During assembly and filling, the carrier 14, base 16 and threaded rod assembly 18 are pre-assembled (so that holes 21, 24, 28 are aligned) and snapped into the body 10 without the plug 20. The body 10 is then filled in a conventional jig or puck (not shown) from the bottom, through the aligned filling holes. Thereafter the plug 20 is snapped into place.

Figure 8:
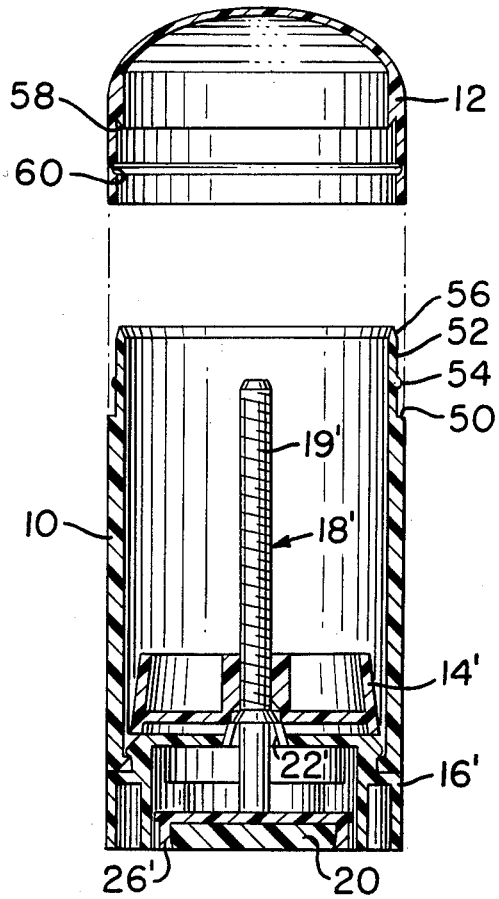
FIG. 8 is a front, sectional view of an alternative embodiment of the invention.
Figure 4:
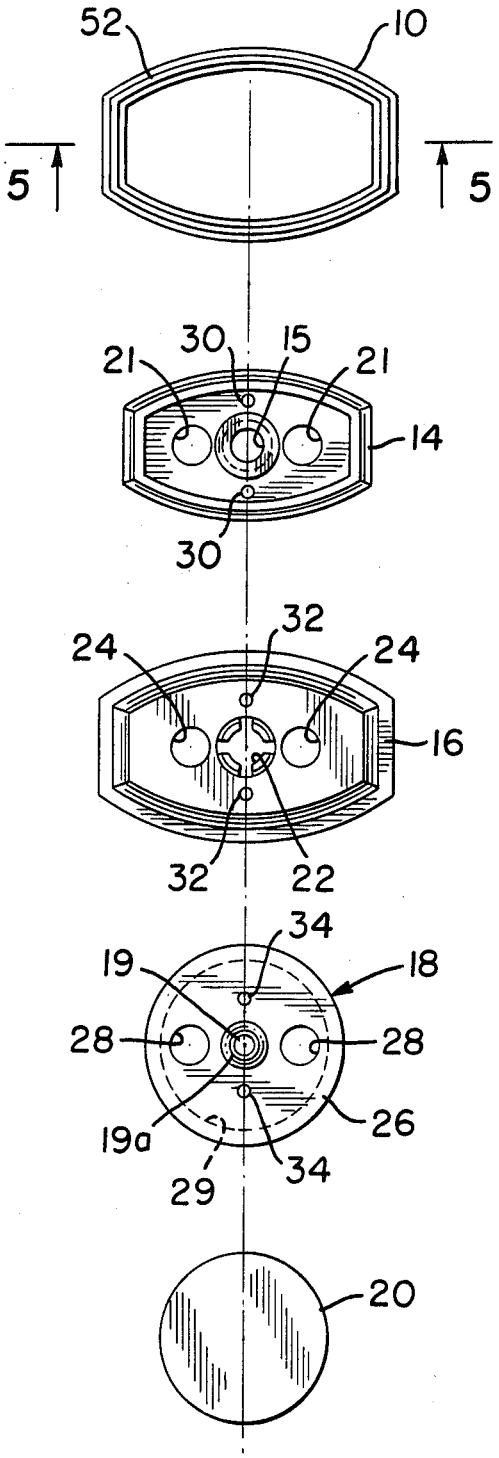
FIG. 4 is an exploded plan view of the parts of the container shown in FIG. 1.

The FIG. 8 embodiment includes a casing body 10, and cap 12, with a carrier 14', base 16', and threaded rod assembly 18'. The carrier, base, and threaded rod assembly are similar to the corresponding elements in the FIGS. 1–7 embodiment, except that no filling holes are provided, and no tabs are provided on the base. The entire assembly after filling is snapped into place in the body of the case. To assist in inserting the assembly, vent holes, similar to those shown in FIG. 5, may be formed in the knob 26', base 16', and carrier 14'. The knob 26' is formed with a recess to receive a plug 20, as shown, which plug is pressed into place after the assembly is inserted into the casing body 10.

Figure 9:
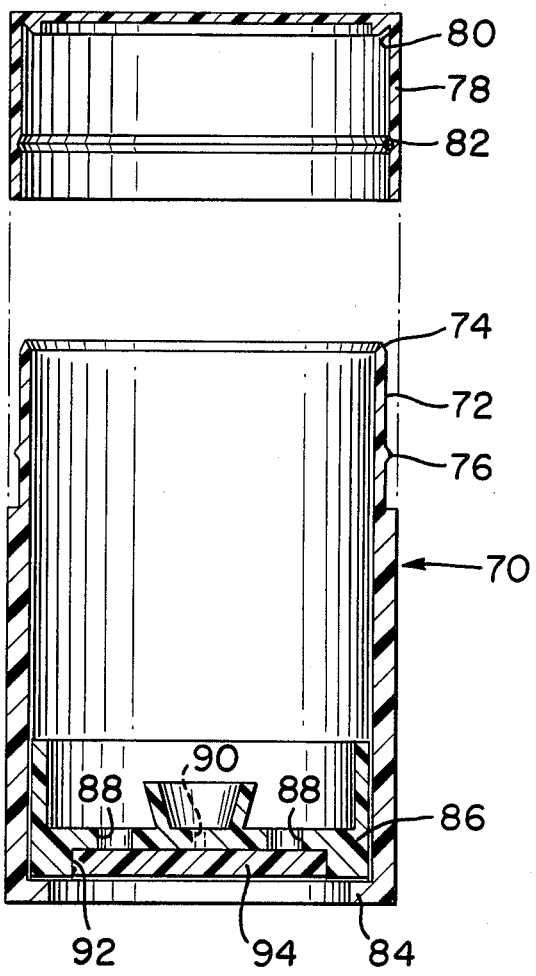
FIG. 9 is a front, sectional view of a further embodiment of the invention.

FIG. 9 illustrates a further embodiment of a deodorant or antiperspirant container, of the type in which the carrier is pushed up manually. The body 70 is formed with a neck portion 72 having an inverted v-shaped upper end 74 and bead 76, and the cap 78 is formed with a cooperating sealing groove 80 and recess 82, similar to the embodiments shown in FIGS. 1–8. A shoulder 84 retains a carrier 86, which is formed with filling holes 88 and vent holes 90 (one shown). The carrier 86 is formed with a recess 92, which can receive a sealing plug 94.

The container shown in FIG. 9 may be filled by inserting carrier 86 into the body 70, and by placing the open end 74 in a jig or puck with the desired shape of the product (or by closing off open end 74 by applying cap 78). The container is back filled through holes 88, and the plug 94 is then attached to seal the bottom.

The foregoing are two preferred embodiments of the invention. Variations and modifications will be apparent to persons skilled in the art, without departing from the inventive concepts disclosed herein. All such modifications and variations are intended to be within the scope of the invention as defined in the following claims.

I claim:

1. A container of the propel-repel type comprising a casing, a carrier disposed in and moveable within said casing and having a threaded bore for receiving a screw, a threaded screw assembly having a knob and a threaded rod received in said threaded bore, and base means engaging said threaded screw assembly for supporting said assembly on said casing, wherein said carrier and said base means have aligned openings for filling, wherein said screw assembly has an opening alignable with the openings in said carrier and base means for filling, and comprising plug means for sealing the opening in said screw assembly after filling.

2. A container as defined in claim 1, wherein said casing has opposite open ends, wherein said base means comprises a base receivable in one said open end and having a hole aligned with said threaded bore for receiving and axially retaining said threaded rod, wherein said base has a recess for receiving said knob and said plug means therein, and wherein said aligned and alignable openings are formed on a carrier support portion of said carrier and said base, and on said knob, respectively.

3. A container as defined in claim 2, wherein said carrier is frusto-conical shape.

4. A container as defined in claim 2, comprising break-away means between said knob and said base for temporarily maintaining the openings in said knob in alignment during filling.

5. A container as defined in claim 4, wherein said knob has an annular portion and wherein said break-away means comprises tabs formed on said base in said recess for engaging said annular portion.

6. A container as defined in claim 2, wherein said knob has a second recess communicating with said alignable opening, and wherein said plug means is disposed in said second recess for sealing said alignable opening.

7. A container as defined in claim 1, wherein said body has an inverted, substantially v-shaped wall at the other open end, and comprising a cap disposed over said other end, said cap having an interior formed with a substantially v-shaped receiving groove receiving the v-shaped end wall for sealing said other end.

8. A container as defined in claim 6, wherein said carrier and base have vent holes therein, and said knob has a vent hole communicating with said recess and sealed off by said plug means.

* * * * *